US005846683A

United States Patent [19]

Murakami et al.

[11] Patent Number: 5,846,683

[45] Date of Patent: Dec. 8, 1998

[54] TONER PRODUCING METHOD USING RECYCLED EXTRA-FINE TONER PARTICLES

[75] Inventors: Toshihiko Murakami; Tadashi Nakamura; Junichi Saito; Yasuharu Morinishi; Takeaki Ouchi; Satoshi Ogawa; Yoshiaki Akazawa, all of Nara, Japan

[73] Assignee: Sharp Kabushiki Kaisha, Osaka, Japan

[21] Appl. No.: 816,391

[22] Filed: Mar. 13, 1997

[30] Foreign Application Priority Data

Apr. 8, 1996 [JP] Japan ..... 8-85565
Jun. 25, 1996 [JP] Japan ..... 8-164168

[51] Int. Cl.[6] ..... G03G 9/087
[52] U.S. Cl. ..... 430/137
[58] Field of Search ..... 430/137, 106, 430/109

[56] References Cited

U.S. PATENT DOCUMENTS 5,589,310 12/1996 Uno et al. ..... 430/137
5,637,734 6/1997 Ikushima et al. ..... 430/137

FOREIGN PATENT DOCUMENTS 6-226158 9/1994 Japan .
6-186775 7/1997 Japan .

*Primary Examiner*—John Goodrow
*Attorney, Agent, or Firm*—David G. Conlin; George W. Neuner

[57] ABSTRACT

The extra-fine toner arising in the toner producing process, is returned to the mixing step where it is mixed again with the binder resin and the coloring agent, and the compound is sent out to the kneading step. In this procedure, the particle size of the binder resin is set in accordance with the particle size and blending amount of the extra-fine toner, the kind of the binder resin, etc. By using the binder resin having the thus determined particle size, the amount of the binder to be fed into the mixer or the amount of the compound ejected from the mixer are maintained uniform. Further, when the extra-fine toner is mixed with the starting materials, the blending ratio of the extra-fine toner to the starting material is set between 5 wt. % and 10 wt. %, and the blending ratios of the charge control agent and the coloring agent are set equal to those of the normal process where no recycled toner is added.

12 Claims, 1 Drawing Sheet

TONER PRODUCING METHOD USING RECYCLED EXTRA-FINE TONER PARTICLES

BACKGROUND OF THE INVENTION (1) Field of the Invention

The present invention relates to a method of producing toner as the developer used in the developing unit in electrostatic recording, etc., based on the electrophotographic process. More detailedly, the present invention is directed to a technology by which finer or more minute toner particles with a prescribed size or below arising during the toner producing method are efficiently recycled to thereby improve the production yield.

(2) Description of the Prior Art

In electrophotographic apparatuses and the like, a static latent image is created on the surface of the photoreceptor surface as a recording support. In order to visualize this latent image, the apparatus has a developing unit for development of the image using developer containing a coloring agent, i.e., toner. The toner contained in the developer attaches to the latent image formed on the photoreceptor surface producing the toner image. This image is in turn transferred to a sheet of paper which is conveyed and controlled in synchronization with the rotation of the photoreceptor. Then, the sheet with the toner image is conveyed to the fixing unit whereby it is fixed as a permanent image.

Known developers are mainly categorized into two classes: two component developers consisting of magnetic carriers and toner particles; and a single component developers not needing carriers, consisting magnetic toner particles which themselves have magnetic properties or consisting of non-magnetic insulative toner particles which have non-magnetic insulative properties.

In the typical method of producing toner constituting the aforementioned two or single component developer, binder resin responsible for heat-fixing the toner to the sheet of paper etc., a coloring agent, a charge controlling agent and a separating agent etc., are dry mixed in mixing step 2 as shown in FIG. 1.

Specifically, first, the binder resin, the coloring agent, the anti-offset agent, the charge control agent (CCA) etc., are measured. Typical examples of the binder resin include: polyester resin, styrene acrylic resin, etc. As a coloring agent, pigments such as carbon black, acetylene black are frequently used. As an anti-offset agent, polypropylene resin etc. is used. Often used as a charge control agent are dyes such as nigrosine derivatives, quaternary ammonium salts, amino-silane derivatives, etc. Then, at the kneading step 3, the mixture is fused and kneaded in a kneader such a bi-axial extruder kneading machine etc. After it solidifies at the cooling step 4, the resultant is crushed to a prescribed particle size, e.g. about 10 $\mu$m by a crushing method using, for instance, a jet stream type crusher etc., at crushing and classification steps 5 and 6, producing toner. In this case, since over-crushed toner particles smaller than a prescribed particle size(e.g., 8 $\mu$m) cause fogginess or other defects on the electrophotographic copy, degrading the quality of the product, they need to be removed by a suitable air classification machine.

The extra-fine toner particles arising in the aforementioned producing method, thus removed during the lower limit classification, may be collected and recycled so as to improve the production yield. Conventionally, the extra-fine toner particles obtained from the lower limit classification is typically recycled into toner in the following method.

The collected extra-fine toner is granulated (agglomerated) by a predetermined pressure, then is returned to the mixing step 2 by way of the procedural path (a) so that it is mixed with the other toner forming materials, kneaded together, crushed and classified so as to be recycled as product toner. An example of the method is described in Japanese Patent Application Laid-Open Hei 6 No. 266,158, etc.

Japanese Patent Application Laid-Open Hei 6 No. 186, 775 discloses a method in which collected extra-fine toner is uniformly scattered and mixed into the toner intermediate after kneading so that it is fused with residual heat from the toner intermediate. Thereafter, the compound is cooled, crushed and classified so as to be recycled into product toner.

In accordance with the conventional toner producing methods, since the extra-fine toner particles unusable as toner is returned to the mixing step and processed, it is very effective to produce toner with a prescribed particle size in view of eliminating waste or recycling.

However, when the extra-fine toner arising from crushing is attempted to be recycled by loading it as it is into the starting compound, the ratio of the micro-fine particle component in the material of toner increases. Resultantly, the fluidity of the starting compound becomes too high, so that frictional contact with the screw portion of the bi-axial extruder kneading machine is degraded causing poor dispersions of the binder resin, coloring agent, charge control agent, separating agent and other fine particles, compared to the case where no extra-fine particles are added.

As a result, the electrification of the toner thus produced fluctuates greatly particle to particle, so that the variation in electrification of the whole toner is broadened compared to the case where no extra-fine particles are added. Further, due to the poor frictional characteristics, a lower amount is ejected from the kneader, thus leading a reduced processing capacity. In order to compensate this, production conditions need to be modified depending upon whether extra-fine toner particles are added or not, thus hindering the work performance.

The toner particles low in electrification and the toner of opposite polarity arising due to these causes adhere to the non-image area on the photoreceptor, increasing the toner consumption per copy and leading to increase of the amount of toner collected into the cleaning box. With this augmentation of the toner consumption, toner scattering inside copier becomes conspicuous.

In order to solve the above problems, in accordance with the conventional method disclosed in Japanese Patent Application Laid-Open Hei 6 No. 266,158, the extra-fine toner particles are once granulated (agglomerated) under a predetermined pressure, then is returned to the mixing step so as to be recycled. However, this method needs a pressurizing and granulating installation, increasing the plant cost.

In accordance with the toner producing method disclosed in Japanese Patent Application Laid-Open Hei 6 No. 186, 775, collected extra-fine toner particles are uniformly scattered and mixed into the toner intermediate after kneading so that the extra-fine toner particles are fused with residual heat from the toner intermediate. Thereafter, the compound is cooled, crushed and classified so as to be recycled into product toner. This method, however needs extra plant cost for uniformly scattering extra-fine toner particles. Further, since dispersibility of the extra-fine toner with the toner intermediate is poor, the thus prepared toner is inferior in performance compared to the case where no extra-fine toner is used.

To make matters worse, if the extra-fine toner particles are loaded as they are and mixed into the starting material in an amount equal to or above a certain ratio (e.g. 10 wt. %), the resultant toner tends to scatter and cause fogginess because of reduced electrification since extra-fine toner contains a larger amount of carbon compared to the properly sized toner. In contrast, if the blending ratio of the extra-fine toner is excessively lowered, it is possible to inhibit the reduction of the electrification, but this cannot contribute improvement of the production efficiency since the consumption of the extra-fine toner is low.

Since the extra-fine toner contains the coloring agent in a higher amount than the toner of a correct size, a simple addition of the extra-fine toner into the normal process will increase the blending ratio of the coloring agent as compared to the case of the normal process.

If the addition of the coloring agent is too much, the toner tends to reduce in electrification, thereby easily scattering and causing fogginess. On the other hand, if the addition is less, the toner increases in electrification, causing difficulty in transferring and lowering the image density. If the addition of the charge control agent is increased, the toner increases in electrification, whereas the toner reduces in electrification if the addition is reduced. Therefore, its addition may be increased or reduced so as to adjust the electrification of the toner.

The binder resin for fixing the toner to the sheet is produced by pearl polymerization or solution polymerization. Since the surface features of the binder differ depending upon the method of preparation, the fluidity varies when the extra-fine toner is added, thereby changing the supply amount from the hopper to the kneader. Therefore, it was necessary to modify the supplying conditions from the hopper depending upon whether extra-fine toner is added or not, in order to establish suitable producing conditions for each binder resin. This lowered the work performance.

SUMMARY OF THE INVENTION

The present invention has been devised to solve the above problems, and it is therefore an object of the present invention to provide a toner producing method which can stably produce good toner by making the amount of the compound materials into the kneader and the amount of the kneaded compound from the kneader at constant even when extra-fine toner is used for recycling.

Particularly, it is an object of the invention to provide a toner producing method which can stably provide a good quality toner even when the production is carried out utilizing binder resins produced by pearl polymerization or solution polymerization.

It is still another object of the invention to provide a toner producing method which can efficiently recycle extra-fine toner arising in accompany with the production of the toner for electrophotography to establish stabilized consumption of toner and provide toner which can produce a stable quality of image.

The present invention has been configured in order to attain the above objects, and the gist of the invention is as follows:

In accordance with the first aspect of the invention, a toner producing method for producing toner particles having a prescribed particle size comprises the steps of: mixing a coloring agent and a binder resin as main components; kneading the compound; cooling the kneaded compound; crushing the cooled compound into particles; classifying the particles; and returning the extra-fine toner particles smaller than the prescribed size to the mixing step for recycling, and is characterized in that the particle size of the binder resin is set so that the tractive ability of the compound entering the kneading shaft during kneading is equivalent to that of the case where no extra-fine toner is added, and this binder resin is blended with the extra-fine toner so as to eject a constant amount of the kneaded compound.

The second aspect of the invention resides in the toner producing method written in the above first feature, wherein the binder resin is produced by pearl polymerization.

The third aspect of the invention resides in the toner producing method written in the above first feature, wherein the binder resin is produced by solution polymerization.

The fourth aspect of the invention resides in the toner producing method written in the above second feature, wherein the binder resin is composed of particles having a particle diameter a (mm) which satisfies the following condition:

$$3.0 \geqq a \geqq k \times (1/b) \times c^2$$

where b is the mean particle diameter ($\mu$m) of the extra-fine toner, c is the blending ratio (wt. %) of the extra-fine toner, and k is equal to $1.5 \times 10^{-2}$ when the binding resin is produced by pearl polymerization.

The fifth aspect of the invention resides in the toner producing method written in the above third feature, wherein the binder resin is composed of particles having a particle diameter a (mm) which satisfies the following condition:

$$3.0 \geqq a \geqq k \times (1/b) \times c^2$$

where b is the mean particle diameter ($\mu$m) of the extra-fine toner, c is the blending ratio (wt. %) of the extra-fine toner, and k is equal to $1.8 \times 10^{-2}$ when the binding resin is produced by solution polymerization.

Next, the sixth aspect of the invention resides in the toner producing method written in the above fourth feature, wherein when the binder resin is of styrene/acrylic (St/Ac) resin based on pearl polymerization, the shape factor of the particle of the binder resin is equal to or below 1.30, where the shape factor is defined as the ratio of the specific surface area Sa obtained by the measurement based on the aeration method and the specific surface area Sb calculated from sieving.

Further, the seventh aspect of the invention resides in the toner producing method written in the above fifth feature, wherein when the binder resin is of styrene/acrylic (St/Ac) resin based on solution polymerization, the shape factor of the particle of the binder resin is equal to or below 2.20, where the shape factor is defined as the ratio of the specific surface area Sa obtained by the measurement based on the aeration method and the specific surface area Sb calculated from sieving.

In accordance with the eighth aspect of the invention, a toner producing method in which the normal process is carried out by the steps of: mixing starting materials of a binder resin, a coloring agent, a charge control agent and the like; fusing and kneading the compound; cooling the kneaded compound; crushing the cooled compound into particles; and classifying the particles into toner particles having a desired particle diameter and extra-fine powder toner equal to or below a prescribed size, comprises the steps of:

mixing the extra-fine powder toner with the starting materials for recycling;

fusing and kneading the compound;

cooling the kneaded compound;

crushing the compound; and classifying the particles, and is characterized in that when the extra-fine toner is blended with the starting materials, the blending ratio of the extra-fine toner to the starting material is set between 5 wt. % and 10 wt. %, and the blending ratios of the charge control agent and the coloring agent are set equal to those of the normal process.

In accordance with the ninth aspect of the invention, a toner producing method in which the normal process is carried out by the steps of: mixing starting materials of a binder resin, a coloring agent, a charge control agent and the like; fusing and kneading the compound; cooling the kneaded compound; crushing the cooled compound into particles; and classifying the particles into toner particles having a desired particle diameter and extra-fine powder toner equal to or below a prescribed size, comprises the steps of:

mixing the extra-fine powder toner with the starting materials for recycling;

fusing and kneading the compound;

cooling the kneaded compound;

crushing the compound; and classifying the particles, and is characterized in that when the extra-fine powder toner is blended with the starting materials, the blending ratio of the extra-fine toner is set between 10 wt. % and 20 wt. %, and the blending ratio of the coloring agent is set equal to that of the coloring agent in the normal process while the blending ratio of the charge control agent is set between 1.5 and 2 times that of the normal process.

In accordance with the tenth aspect of the invention, a toner producing method in which the normal process is carried out by the steps of: mixing starting materials of a binder resin, a coloring agent, a charge control agent and the like; fusing and kneading the compound; cooling the kneaded compound; crushing the cooled compound into particles; and classifying the particles into toner particles having a desired particle diameter and extra-fine powder toner equal to or below a prescribed size, comprises the steps of:

mixing the extra-fine powder toner with the starting materials for recycling;

fusing and kneading the compound;

cooling the kneaded compound;

crushing the compound; and classifying the particles, and is characterized in that when the extra-fine powder toner is blended with the starting materials, the blending ratio of the extra-fine toner is set between 10 wt. % and 20 wt. %, and the blending ratio of the charge control agent is set equal to that of the charge control agent in the normal process while the blending ratio of the coloring agent is set between 0.66 and 0.83 times that of the normal process.

In accordance with the eleventh aspect of the invention, a toner producing method in which the normal process is carried out by the steps of: mixing starting materials of a binder resin, a coloring agent, a charge control agent and the like; fusing and kneading the compound; cooling the kneaded compound; crushing the cooled compound into particles; and classifying the particles into toner particles having a desired particle diameter and extra-fine powder toner equal to or below a prescribed size, comprises the steps of:

mixing the extra-fine powder toner with the starting materials for recycling;

fusing and kneading the compound;

cooling the kneaded compound;

crushing the compound; and classifying the particles, and is characterized in that when the extra-fine powder toner is blended with the starting materials, the blending ratio of the extra-fine toner is set between 10 wt. % and 15 wt. %, and the blending ratio of the charge control agent is set between 1.6 and 1.8 times that in the normal process while the blending ratio of the coloring agent is set between 0.7 and 0.75 times that of the normal process.

In the toner producing methods configured based on the first to seventh features, if the mean particle size of the extra-fine toner to be recycled becomes smaller, the fluidity of the mixture of the toner materials increases. Due to this augmentation, the tractive ability of the compound entering the kneading shaft during fusing and kneading is degraded, resultantly the amount of the kneaded compound ejected decreases, thus lowering the productivity.

The fluidity of the mixture of the toner materials increases also when the added amount of the extra-fine toner is greater. With this augmentation, the tractive ability of the compound entering the kneading shaft during fusing and kneading is degraded, resultantly the amount of the kneaded compound ejected decreases, thus lowering the productivity. In these cases, in the prior art, producing conditions needed to be examined and adjusted such as the rotational rate and other factors of the bi-axial extruder kneading machine.

When the mean particle size of the pearl polymerization resin is greater than 3.0 mm, the dispersing performances of the toner materials lower, thus each component will not be sufficiently disposed even after fusing and kneading. Consequently, the resulting toner can not produce images of high equality.

However, in the invention, by limiting the mean particle size of the binder resin within a prescribed range, it is possible to produce toner offering good performances without changing the tractive ability of the compound entering the kneading shaft during fusing and kneading even when extra-fine toner is added, in a stable manner as in the case where no extra-fine toner is reused.

In particular, use of the binder resin to be mixed with extra-fine toner, whose mean particle size a (mm) satisfies the above formula, prevents degradation of the dispersing performances, thus making it possible to produce a stabilized toner of good performances.

Here, the mean particle size b of the extra-fine toner in the above formula was measured using a Coulter counter TA-II, a product of Coulter Electronics, Inc. The measuring method is as follows: put a small amount of pure water into a beaker with addition of a drop of a surface active agent (a liquid detergent); add a small amount of the extra-fine toner and stir it up; dilute it with pure water to 100 cc in total; subject the beaker to an ultrasonic cleaner for scattering for 1 min.; put ISOTON-II into the sample beaker in the measuring section with its aperture set at 100 $\mu$m in diameter; measure up to 100K counts; and take the value as the volume-mean particle size.

In the above formula, the blending ratio c (%) of the extra-fine toner is calculated as follows:

c=(added amount (kg) of extra-fine toner/total weight (kg) of toner materials)×100.

The surface condition of the resin differs depending upon the polymerization method of the resin; $k=1.5\times10^{-2}$ in the formula is the value unique to the pearl polymerization resin. The constant k unique to the solution polymerization resin is: $k=1.8\times10^{-2}$.

In the method for producing toner for electrophotography, if the pearl polymerization resin used has distorted shapes or rough surfaces with irregularities, the frictional forces between particles in the toner material compound are higher. Accordingly, the fluidity varies when the extra-fine toner is added, thereby changing the supply amount from the hopper to the kneader. Therefore, it was necessary to modify the supplying conditions from the hopper depending upon whether extra-fine toner is added or not, in order to establish suitable producing conditions for each binder resin. This lowered the work performance.

To deal with this, in the invention, the shape factor representing the degree of distortion of pearl polymerization resin, for example, is specified to fall within a prescribed range, so that the amount of the material fed from the hopper to the kneader does not vary even with the addition of the extra-fine toner. Consequently, it becomes possible to stably produce toner of good performance.

The term 'shape' factor used here is defined as the ratio of the specific surface area Sa obtained by the measurement of the binder resin based on the aeration method and the specific surface area Sb calculated from sieving.

Illustratively, the specific surface area Sa measured by the aeration method can be determined based on the so-called BET theory. In practice, the measurement was performed by the multi-point method using Quantasorb QS-18, a specific surface area meter manufactured by YUASA IONICS Co., Ltd. with He as the carrier gas and Kr as the adsorbed gas.

The specific surface area Sb calculated from sieving is determined by the following procedure: First, determine the mean particle diameter r (cm) by a so-called sieve shaking technique; set a stack of standard screens with different mesh sizes (5, 7, 9, 10, 20, 32, 100 mesh screens with 150 mm in inner diameter and 45 mm in depth) defined by JIS8801-19765 in a ro-tap sieve shaker; sift 150 g of the pearl polymerization resin for 10 minutes at vibration rates of 156 times per min. and 290 times per min; plot a graph of mesh size (Mesh, mm) along the horizontal axis and the sum of weight proportions (%) of the remainder in the screens of corresponding mesh sizes or below along the vertical axis; draw a horizontal line from a point on the vertical axis where the weight sum is 50% to determine an intersection with the plot; draw a perpendicular line from the intersection to the horizontal axis; and read the value (mm) on the horizontal axis and take it as the mean particle diameter of the pearl polymerization resin. Based on this, the surface area Sc ($cm^2/g$) per particle is determined assuming the resin particles are of true spheres.

Next, the number of the pearl polymerization resin particles per gram is determined by dividing the true specific gravity $\rho$ ($g/cm^3$) of the pearl polymerization resin determined by a known method, by the volume per particle when the resin particles are assumed to be of true spheres.

Finally, the obtained surface area per particle is multiplied by the obtained number of particles per gram so as to determine the specific surface area Sb. This can be summarized as the following formula:

$$[\text{Specific surface area Sb } (cm^2/g) \text{ calculated from sieving}]=[\text{True specific gravity } \rho\ (g/cm^3)]/[\text{Volume per particle } (4/3)\pi r^3]\times[\text{Surface area Sc per particle } (cm^2/g)]$$

The shape factor of the pearl polymerization resin is determined by dividing the aforementioned specific surface area Sa measured by the aeration technique by the specific surface area Sb calculated from sieving. The surface condition of the resin, which varies depending upon the resin polymerizing method used, will produce differences in the coefficients of friction. In the case of the styrene/acrylic (St/Ac) pearl polymerization resin, it has a smooth surface and a grape-like shape. Therefore, when the shape factor is equal to or below 1.30, the amount of the material fed from the mixer (hopper) to the kneader does not vary and thereby it is possible to stably produce toner of good performance.

Separately from the pearl polymerization resin, it is also possible to determine the shape factor for the solution polymerization resin by dividing the specific surface area Sa measured in the same manner as above, by the specific surface area Sb calculated from sieving.

The surface condition of the resin, which varies depending upon the resin polymerizing method used, will produce differences in the coefficients of friction. In the case of the styrene/acrylic (St/Ac) solution polymerization resin, it has many irregularities on its surface and has irregular shapes. Since the increase of the specific surface area based on BET theory is out of proportion of the variation in coefficient of friction, when the shape factor is equal to or below 2.20, the amount of the material fed from the mixer (hopper) to the kneader does not vary and thereby it is possible to stably produce toner of good performance.

In the producing method configured according to the eighth aspect of the invention, in order to reuse the extra-fine toner equal to or below a prescribed size arising through the process (this process will be referred to hereinbelow as the normal process) wherein starting materials of a binder resin, a coloring agent, a charge control agent and the like are mixed to be fused and kneaded, followed by cooling, crushing and classification, the extra-fine toner is added to the above starting materials, and then the compound after it is fused and kneaded, is cooled, crushed and classified (this process will be referred to hereinbelow as the recycling process). In this recycling process, when the extra-fine powder toner is blended with the starting materials, the blending ratio of the extra-fine toner to the starting material is set between 5 wt. % and 10 wt. %, and the blending ratios of the charge control agent and the coloring agent are set equal to those of the normal process. This setting allows toner fogginess and toner scattering to be inhibited with a satisfactory image density, thus making it possible to produce toner which can offer stable properties and a stable quality of image.

In the producing method configured according to the ninth aspect of the invention, in order to reuse the extra-fine toner equal to or below a prescribed size arising through the normal process, the extra-fine toner is blended with starting materials of a binder resin, a coloring agent, a charge control agent and the like, and then the compound after it is fused and kneaded, is cooled, crushed and classified.

In this recycling process, when the extra-fine powder toner is blended with the starting materials, the blending ratio of the extra-fine toner is set between 10 wt. % and 20 wt. %. In this case, since the extra-fine toner contains a greater amount of the coloring agent than does the toner of the prescribed particle size, if it is added without limitation, the blending ratio of the coloring agent increases compared to that of the normal process, so that the electrification of the resultant toner might be lowered, possibly causing background fogginess and toner scattering.

For this reason, when the blending ratio of the coloring agent is set equal to that of the coloring agent in the normal process, the blending ratio of the charge control agent (CCA) should be set greater than in the normal process, specifically set between 1.5 and 2 times that of the normal process. Thus, the reduction of the electrification accompanied by the augmentation of the blending ratio of the coloring agent can be compensated by the increase of the blending ratio of the charge control agent.

This setting allows toner fogginess and toner scattering to be inhibited with a satisfactory image density, thus making it possible to produce toner which can offer stable properties and a stable quality of image.

In the producing method configured according to the tenth aspect of the invention, in order to reuse the extra-fine toner equal to or below a prescribed size arising through the normal process, the extra-fine toner is blended with starting materials of a binder resin, a coloring agent, a charge control agent and the like, and then the compound after it is fused and kneaded, is cooled, crushed and classified.

In this recycling process, when the extra-fine powder toner is blended with the starting materials, the blending ratio of the extra-fine toner is set between 10 wt. % and 20 wt. %. In this case, since the extra-fine toner contains a greater amount of the coloring agent than does the toner of the prescribed particle size, if it is added without limitation, the blending ratio of the coloring agent increases compared to that of the normal process, so that the electrification of the resultant toner might be lowered, possibly causing background fogginess and toner scattering.

For this reason, when the blending ratio of the charge control agent (CCA) is set equal to that in the normal process, the blending ratio of the coloring agent should be set lower than that of the normal process, specifically set between 0.66 and 0.83 times that of the normal process. Thus, the blending ratio of the coloring agent becomes equal to that of the normal process, thereby inhibiting the reduction in electrification.

This setting allows toner fogginess and toner scattering to be inhibited with a satisfactory image density, thus making it possible to produce toner which can offer stable properties and a stable quality of image.

In the producing method configured according to the eleventh aspect of the invention, in order to reuse the extra-fine toner equal to or below a prescribed size arising through the normal process, the extra-fine toner is blended with starting materials of a binder resin, a coloring agent, a charge control agent and the like, and then the compound after it is fused and kneaded, is cooled, crushed and classified.

In this recycling process, when the extra-fine powder toner is blended with the starting materials, the blending ratio of the extra-fine toner is set between 10 wt. % and 15 wt. %. In this case, since the extra-fine toner contains a greater amount of the coloring agent than does the toner of the prescribed particle size, if it is added without limitation, the blending ratio of the coloring agent increases compared to that of the normal process, so that the electrification of the resultant toner might be lowered, possibly causing background fogginess and toner scattering.

For this reason, the blending ratio of the charge control agent (CCA) is set greater than that of the normal process, specifically between 1.6 and 1.8 times that in the normal process while the blending ratio of the coloring agent is set lower than that of the normal process, specifically set between 0.7 and 0.75 times that of the normal process.

Thus, the blending ratio of the coloring agent can be inhibited from increasing from that of the normal process, and the charge control agent is added in a greater amount than in the case of the normal process. As a result, it is possible to produce toner having the same electrification properties as obtained in the case of the normal process.

This setting allows toner fogginess and toner scattering to be inhibited with a satisfactory image density, thus making it possible to produce toner which can offer stable properties and a stable quality of image.

DESCRIPTION OF THE PREFERRED EMBODIMENTS

Figure 1:
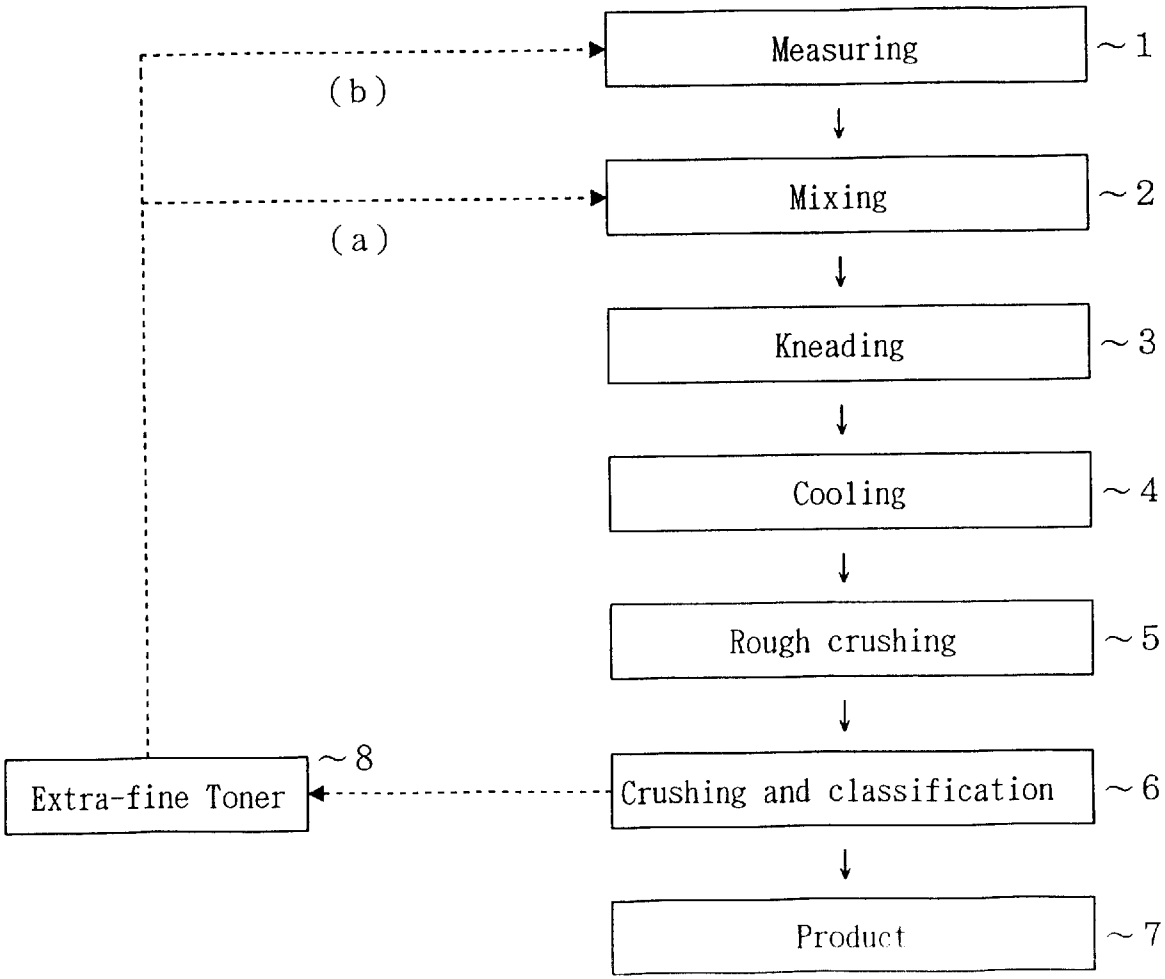
FIG. 1 is a typical diagram of a production flow showing the toner producing method in accordance with the invention.

Next, in order to clarify the outstanding points of the embodiments or the invention, the toner producing method of the invention will be detailed using comparative examples.

First, the toner producing method of the invention will be explained with reference to FIG. 1. The toner includes at least a binding resin and a coloring agent as main components. These components are measured in the measuring step 1 and mixed by dispersion in the mixing step 2.

The binder resin for the invention uses a styrene copolymer, but other known resins may be used or mixed therewith. Examples of these include polyester resins; epoxy resins, silicone resins, polystyrene, polyamide resins, polyurethane resins, acrylic resins, etc.

Coloring material used for the invention may be of various kinds. Examples include carbon black, iron-black, nigrosine, benzene yellow, quinacridone, rhodamine B, phthalocyanine blue, etc. The blending ratio of these is 3 to 12 parts of the coloring agent by weight assuming that the total resin is 100 parts by weight.

When a single-component magnetic toner is used as the toner of the invention, the toner may and should contain magnetic powder. As the magnetic powder, a material which is magnetized when it is placed in magnetic fields is used. Examples include ferromagnetic metal powders of iron, cobalt, nickel etc., compounds such as magnetite, hematite, ferrite, etc. The content of the magnetic powder is 15 to 70 parts by weight of the total toner weight. When two-component developer is used, no magnetic powder will be added.

The toner may include various additives for different purposes, as required. Examples of such additives include charge control agents such as metallic complexes, nigrosine, quaternary ammonium salts, etc.

The separating agent, may be olefin polymers of ethylene series such as polyethylene, polypropylene, ethylene-propylene copolymers, ethylene-vinyl acetate copolymers, ethylene-ethyl acrylate copolymers, ionomers having a polyethylene skeleton, etc. The separating agent comprises a small amount, specifically 0.1 to 5 parts by weight of the total toner weight, preferably 0.2 to 3 parts by weight, improving fixing and developing performances.

When the content of the olefin polymer of ethylene series is 0.1 part or below by weight, it has little effect. On the other hand, if it comprises 5 parts by weight, agglomeration of the toner increases, resultantly lowering the fluidity.

When the toner of the invention uses a two-component developer, carrier particles such as iron powder, ferrite powder, magnetite powder, glass beads, nickel powder or the like are mixed as an electric latent image forming agent.

These toner forming materials are loaded into a mixer in required amounts and mixed for a required period of time. The mixer for the mixing step 2 may use a double cone mixer, V-shaped mixer, drum-type mixer, super mixer, Henschel mixer, Nauta mixer, etc.

The compound which is mixed in the mixing step 2, is sent to the kneading step 3 where it is fused and mixed. The kneader for the kneading step 3 generally uses a continuous type; a bi-axial extruder is mainly used in recent years.

After the completion of the kneading step 3, the kneaded compound is cooled in the cooling step 4, and then roughly crushed in the crushing step 5. A crushing means for the crushing step 5 may use a crusher, hammer mill, feather mill, etc., for rough crushing.

Thereafter, at the final stage, the crushing and classification step 6, particles which have particle size suitable for use as toner are picked out. The crushing means for this purpose may be a jet mill, high-speed rotor mill etc., crushing to a prescribed particle size. Particles falling within the range of the prescribed sizes are classified as a toner product (7).

The leftover, extra-fine toner particles (8) unselected by the classification are returned to the measuring step 1 by way of the procedural path (b) for recycling, where a predetermined amount is supplied to the mixing step 2 for recycling.

In this way, the extra-fine toner particles are recycled to eliminate waste and improve the productivity. The description will be followed by examples of the invention and comparative examples.

COMPARATIVE EXAMPLE 1

A hundred parts by weight of styrene acrylic copolymer (binder) resin with a mean particle size of 0.2 mm and a shape factor of 1.30, produced by pearl polymerization, 6 parts of carbon black by weight, 3 parts of low-molecular polypropylene by weight and 2 parts of a charge control agent were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 1 having a desired particle size. Conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 75%; and total direct yield of the product: 85%.

In the above case, the mean size of the extra-fine toner particles (to be referred to as extra-fine powder 1) obtained after the lower-limit classification was 5.0 $\mu$m.

The thus obtained toner 1 of a desired particle size was tested in an SF-7800 copier, a product of Sharp Corporation, images of high quality were obtained since the toner was produced without addition of the extra-fine toner.

COMPARATIVE EXAMPLE 2

A hundred parts by weight of styrene acrylic copolymer binder resin with a mean particle size of 0.2 mm and a shape factor of 1.30, produced by pearl polymerization, 6 parts of carbon black by weight, 3 parts of low-molecular polypropylene by weight, 2 parts of a charge control agent and 10 parts by weight of extra-fine powder 1 obtained in (Comparative example 1) were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 2 having a desired particle size. Here, conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 90 Kg/h;

yield of the product from the jet mill crusher: 75%; and total direct yield of the product: 85%.

The thus obtained toner 2 was tested in an SF-7800 copier, a product of Sharp Kabushiki Kaisha, image obtained was not satisfactory.

EXAMPLE 1

Styrene acrylic copolymer binder resin with a mean particle size of 0.3 mm and a shape factor of 1.30, was used as a binder resin; other conditions were set at the same as in (Comparative example 2) to produce toner 3. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 90 Kg/h;

yield of the product from the jet mill crusher: 85%; and total direct yield of the product: 88%.

The thus obtained toner 3 was tested in an SF-7800 copier, a product of Sharp Kabushiki Kaisha, images of high quality were obtained.

COMPARATIVE EXAMPLE 3

Styrene acrylic copolymer binder resin with a mean particle size of 0.15 mm and a shape factor of 1.30, was used as a binder resin and 8 parts by weight of extra-fine powder 1 obtained from (Comparative example 1) was mixed; other conditions were set at the same as in (Comparative example 2) to produce toner 4. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 90 Kg/h;

yield of the product from the jet mill crusher: 85%; and total direct yield of the product: 88%.

The thus obtained toner 4 was tested in an SF-7800 copier, a product of Sharp Kabushiki Kaisha, image obtained was not satisfactory.

EXAMPLE 2

Styrene acrylic copolymer binder resin with a mean particle size of 0.192 mm and a shape factor of 1.30, was used as a binder resin and 8 parts by weight of extra-fine powder 1 obtained from (Comparative example 1) was mixed; other conditions were set at the same as in (Comparative example 3) to produce toner 5. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 5 was tested in an SF-7800 copier, a product of Sharp Kabushiki Kaisha, image obtained was not satisfactory.

EXAMPLE 3

Styrene acrylic copolymer binder resin with a mean particle size of 3.0 mm and a shape factor of 1.30, was used as a binder resin; other conditions were set at the same as in (Comparative example 2) to produce toner 6. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 6 was tested in an SF-7800 copier, a product of Sharp Kabushiki Kaisha, images of high quality were obtained.

COMPARATIVE EXAMPLE 4

Styrene acrylic copolymer binder resin with a mean particle size of 3.1 mm and a shape factor of 1.30, was used as a binder resin; other conditions were set at the same as in (Example 3) to produce toner 7. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 7 was tested in an SF-7800 copier, a product of Sharp Kabushiki Kaisha, image obtained was not satisfactory.

COMPARATIVE EXAMPLE 5

Styrene acrylic copolymer binder resin with a mean particle size of 0.3 mm and a shape factor of 1.40, was used as a binder resin; other conditions were set at the same as in (Comparative example 2) to produce toner 8. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 8 was tested in an SF-7800 copier, a product of Sharp Kabushiki Kaisha, image obtained was not satisfactory.

COMPARATIVE EXAMPLE 6

A hundred parts by weight of styrene acrylic copolymer binder resin with a mean particle size of 0.3 mm and a shape factor of 1.20, produced by pearl polymerization, 6 parts of carbon black by weight, 3 parts of low-molecular polypropylene by weight and 2 parts of a charge control agent were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 9 having a desired particle size. Here, conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 78%.

In the above case, the mean size of the extra-fine toner particles (to be referred to as extra-fine powder 2) obtained after the lower-limit classification was 4.0 $\mu$m.

The thus obtained toner 9 of a desired particle size was tested in an SF-7800 copier, a product of Sharp Kabushiki Kaisha, images of high quality were obtained since the toner was produced without addition of the extra-fine toner.

COMPARATIVE EXAMPLE 7

A hundred parts by weight of styrene acrylic copolymer binder resin with a mean particle size of 0.3 mm and a shape factor of 1.20, produced by pearl polymerization, 6 parts of carbon black by weight, 3 parts of low-molecular polypropylene by weight and 2 parts of a charge control agent and 10 parts by weight of extra-fine powder 2 obtained in (Comparative example 2) as a recycling component were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 10 having a desired particle size. Here, conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 75%; and total direct yield of the product: 85%.

The thus obtained toner 10 of a desired particle size was tested in an SF-7800 copier, a product of Sharp Kabushiki Kaisha, image obtained was not satisfactory.

EXAMPLE 4

Styrene acrylic copolymer binder resin with a mean particle size of 0.375 mm and a shape factor of 1.20, was used as a binder resin; other conditions were set at the same as in (Comparative example 7) to produce toner 11. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 11 was tested in an SF-7800 copier, a product of Sharp Kabushiki Kaisha, images of high quality were obtained.

In the above examples, the binding resin (binder) was produced by pearl polymerization. Now, examples will be described in which the binding resin was produced by solution polymerization.

COMPARATIVE EXAMPLE 8

A hundred parts by weight of styrene acrylic copolymer binder resin with a mean particle size of 0.35 mm and a shape factor of 2.20, produced by solution polymerization, 6 parts of carbon black by weight, 3 parts of low-molecular polypropylene by weight and 2 parts of a charge control agent were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 12 having a desired particle size. Conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher; 85%; and total direct yield of the product: 78%.

In the above case, the mean size of the extra-fine toner particles (to be referred to as extra-fine powder 3) obtained after the lower-limit classification was 4.5 $\mu$m.

The thus obtained toner 12 of a desired particle size was tested in an SF-7800 copier, a product of Sharp Kabushiki Kaisha, images of high quality were obtained since the toner was produced without addition of the extra-fine toner.

COMPARATIVE EXAMPLE 9

A hundred parts by weight of styrene acrylic copolymer binder resin with a mean particle size of 0.35 mm and a shape factor of 2.20, produced by solution polymerization, 6 parts of carbon black by weight, 3 parts of low-molecular polypropylene by weight, 2 parts of a charge control agent and 10 parts by weight of extra-fine powder 3 obtained in (Comparative example 8) were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 13 having a desired particle size. Here, conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 82 Kg/h;

yield of the product from the jet mill crusher: 83%; and total direct yield of the product: 82%.

The thus obtained toner 13 was tested in an SF-7800 copier, a product of Sharp Kabushiki Kaisha, image obtained was not satisfactory.

EXAMPLE 5

Styrene acrylic copolymer binder resin with a mean particle size of 0.4 mm and a shape factor of 2.20, was used as a binder resin; other conditions were set at the same as in (Comparative example 9) to produce toner 14. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 3 was tested in an SF-7800 copier, a product of Sharp Kabushiki Kaisha, images of high quality were obtained.

COMPARATIVE EXAMPLE 10

Styrene acrylic copolymer binder resin with a mean particle size of 0.24 mm and a shape factor of 2.20, was used as a binder resin and 8 parts by weight of extra-fine powder 3 obtained from (Comparative example 8) was mixed; other conditions were set at the same as in (Comparative example 9) to produce toner 15. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 85 Kg/h;

yield of the product from the jet mill crusher: 80%; and total direct yield of the product: 82%.

The thus obtained toner 15 was tested in an SF-7800 copier, a product of Sharp Kabushiki Kaisha, image obtained was not satisfactory.

EXAMPLE 6

Styrene acrylic copolymer binder resin with a mean particle size of 0.256 mm and a shape factor of 2.20, was used as a binder resin and 8 parts by weight of extra-fine powder 3 obtained from (Comparative example 8) was mixed; other conditions were set at the same as in (Comparative example 10) to produce toner 16. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 86%.

The thus obtained toner 16 was tested in an SF-7800 copier, a product of Sharp Kabushiki Kaisha, images of high quality were obtained.

EXAMPLE 7

Styrene acrylic copolymer binder resin with a mean particle size of 3.0 mm and a shape factor of 2.20, was used as a binder resin; other conditions were set at the same as in (Comparative example 9) to produce toner 15. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 3 was tested in an SF-7800 copier, a product of Sharp Kabushiki Kaisha, images of high quality were obtained.

COMPARATIVE EXAMPLE 11

Styrene acrylic copolymer binder resin with a mean particle size of 3.1 mm and a shape factor of 2.20; other conditions were set at the same as in (Example 7) to produce toner 18. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 81%; and total direct yield of the product: 83%.

The thus obtained toner 18 was tested in an SF-7800 copier, a product of Sharp Kabushiki Kaisha, image obtained was not satisfactory.

COMPARATIVE EXAMPLE 12

Styrene acrylic copolymer binder resin with a mean particle size of 0.4 mm and a shape factor of 2.30; other conditions were set at the same as in (Comparative example 9) to produce toner 19. Conditions for this process were as follows:

feeder rotating speed for supplying the material from the bi-axial extruder kneading machine: 10 rpm;

amount of the material fed from the bi-axial extruder kneading machine: 86 Kg/h;

amount of the kneaded compound ejected from the bi-axial extruder kneading machine: 86 Kg/h;

yield of the product from the jet mill crusher: 81%; and total direct yield of the product: 83%.

The thus obtained toner 19 was tested in an SF-7800 copier, a product of Sharp Kabushiki Kaisha, image obtained was not satisfactory.

COMPARATIVE EXAMPLE 13

A hundred parts by weight of styrene acrylic copolymer binder resin with a mean particle size of 0.4 mm and a shape factor of 2.10, produced by solution polymerization, 6 parts of carbon black by weight, 3 parts of low-molecular polypropylene by weight and 2 parts of a charge control agent were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 20 having a desired particle size. Here, conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 78%.

In the above case, the mean size of the extra-fine toner particles (to be referred to as extra-fine powder 4) obtained after the lower-limit classification was 4.0 $\mu$m.

The thus obtained toner 20 was tested in an SF-7800 copier, a product of Sharp Kabushiki Kaisha, images of high quality were obtained since the toner was produced without addition of the extra-fine toner.

COMPARATIVE EXAMPLE 14

A hundred parts by weight of styrene acrylic copolymer binder resin with a mean particle size of 0.4 mm and a shape factor of 2.10, produced by solution polymerization, 6 parts of carbon black by weight, 3 parts of low-molecular polypropylene by weight, 2 parts of a charge control agent and 10 parts by weight of extra-fine powder 4 obtained in (Comparative example 12) were mixed and this was fused and kneaded by a bi-axial extruder kneading machine having a toner material supplying port. Then the resultant was crushed by a jet mill crusher of NIPPON PNEUMATIC MANUFACTURING Co., Ltd. and then classified to produce toner 21 having a desired particle size. Conditions for this production process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 90 Kg/h;

yield of the product from the jet mill crusher: 80%; and total direct yield of the product: 81%.

The thus obtained toner 21 of a desired particle size was tested in an SF-7800 copier, a product of Sharp Kabushiki Kaisha, image obtained was not satisfactory.

EXAMPLE 8

Styrene acrylic copolymer binder resin with a mean particle size of 0.375 mm and a shape factor of 2.10, was used as a binder resin; other conditions were set at the same as in (Comparative example 14) to produce toner 22. Conditions for this process were as follows:

feeder rotating speed for supplying the material from the bi-axial extruder kneading machine: 10 rpm;

amount of the material fed from the bi-axial extruder kneading machine: 100 Kg/h;

amount of the kneaded compound ejected from the bi-axial extruder kneading machine: 100 Kg/h;

yield of the product from the jet mill crusher: 85%; and total direct yield of the product: 88%.

The thus obtained toner 22 was tested in an SF-7800 copier, a product of Sharp Kabushiki Kaisha, images of high quality were obtained.

The evaluations concerning the toner produced in the above examples and comparative examples are shown in Table 1 and Table 2. Table 1 shows cases in which the binder resin was produced by pearl polymerization.

From Table 1, it is understood to be important that the particle size a (mm) of the binding resin should be equal to or below 3.0 mm in order to maintain a good quality of image. It is important that the lower limit of the particle size a (mm) is set at a value equal to $(k/b)\times c^2$ where k ($k=1.5\times 10^{-2}$) is a constant unique to the binder resin obtained by pearl polymerization, b ($\mu$m) is the mean particle size of the extra-fine toner particles, c (%) is the added amount of the extra-fine toner. This can be confirmed from the comparison between (Example 1) and (Comparative example 2). A binder resin having a particle size a (mm) of 0.300 mm was used in (Example 1) whereas a binder resin having a particle size of 0.200 mm was used in (Comparative example 2). From these examples, if the lower limit of the particle size of the binding resin is equal to or above 0.3, the value obtained from $(k/b)\times c^2$, it is possible to obtain a good quality of image. Accordingly, it is important that the lower limit of the particle size of the binder resin is equal to or above the above formula.

However, in Table 1, even when the particle size a (mm) of the binder resin was set equal to or above the lower limit obtained from the above formula, there were cases in which satisfactory image could not be formed. This is attributed to the value of the shape factor. That is, if the shape factor exceeds a certain value, the image formed with the thus produced toner becomes bad. It is important that shape factor should be 1.30 or below.

The term 'shape factor' used here is defined as the ratio of the specific surface area Sa obtained by the measurement of the binder resin based on the aeration method and the specific surface area Sb calculated from sieving.

Illustratively, the specific surface area Sa measured by the aeration method can be determined based on the so-called BET theory. In practice, the measurement was performed by the multi-point method using Quantasorb QS-18, a specific surface area meter manufactured by YUASA IONICS Co., Ltd. with He as the carrier gas and Kr as the adsorbed gas.

TABLE 1

| | Toner name | Resin particle size (a)mm | $kx(1/b)\times c^2$ ($k = 1.5\times 10^{-2}$) | Shape coefficient | Powder amount (c)% | Powder particle size (b)$\mu$m | Feeding amount of supplying material kg/h | Ejecting amount of the kneaded kg/h | Crushing yield % | Direct product yield % | Image quality evaluation |
|---|---|---|---|---|---|---|---|---|---|---|---|
| CEx. 1 | Toner 1 | 0.200 | — | 1.30 | — | — | 100 | 100 | 85 | 78 | Good |
| CEx. 2 | Toner 2 | 0.200 | 0.3 | 1.30 | 10 | 5.0 | 100 | 82 | 82 | 82 | Bad |
| Ex. 1 | Toner 3 | 0.300 | 0.3 | 1.30 | 10 | 5.0 | 100 | 100 | 85 | 88 | Good |
| CEx. 3 | Toner 4 | 0.150 | 0.192 | 1.30 | 8 | 5.0 | 100 | 85 | 80 | 83 | Bad |
| Ex. 2 | Toner 5 | 0.192 | 0.192 | 1.30 | 8 | 5.0 | 100 | 100 | 85 | 86 | Good |
| Ex. 3 | Toner 6 | 3.000 | 0.3 | 1.30 | 10 | 5.0 | 100 | 100 | 85 | 88 | Good |
| CEx. 4 | Toner 7 | 3.100 | 0.3 | 1.30 | 10 | 5.0 | 100 | 100 | 80 | 82 | Bad |
| CEx. 5 | Toner 8 | 0.300 | 0.3 | 1.40 | 10 | 5.0 | 80.2 | 80.2 | 82 | 83 | Bad |
| CEx. 6 | Toner 9 | 0.300 | — | 1.20 | — | — | 100 | 100 | 85 | 78 | Good |
| CEx. 7 | Toner 10 | 0.300 | 0.375 | 1.20 | 10 | 4.0 | 100 | 90 | 83 | 82 | Bad |
| Ex. 4 | Toner 11 | 0.375 | 0.375 | 1.20 | 10 | 4.0 | 100 | 100 | 85 | 88 | Good |

CEx.: represents Comparative Example
Ex: represents Example

The specific surface area Sb calculated from sieving is determined by the following procedure: First, determine the mean particle diameter r (cm) by a so-called sieve shaking technique; set a stack of standard screens with different mesh sizes (5, 7, 9, 10, 20, 32, 100 mesh screens with 150 mm in inner diameter and 45 mm in depth) defined by JIS8801-19765 in a ro-tap sieve shaker; sift 150 g of the binder resin for 10 minutes at vibration rates of 156 times per min. and 290 times per min; plot a graph of mesh size (Mesh, mm) along the horizontal axis and the sum of weight proportions (%) of the remainder in the screens of corresponding mesh sizes or below along the vertical axis; draw a horizontal line from a point on the vertical axis where the weight sum is 50% to determine an intersection with the plot; draw a perpendicular line from the intersection to the horizontal axis; and read the value (mm) on the horizontal axis and take it as the mean particle diameter of the pearl polymerization resin. Based on this, the surface area Sc ($cm^2/g$) per particle is determined assuming the resin particles are of true spheres.

Next, the number of the pearl polymerization resin particles per gram is determined by dividing the true specific gravity $\rho$ ($g/cm^3$) of the binder resin determined by a known method, by the volume per particle when the resin particles are assumed to be of true spheres.

Finally, the obtained surface area per particle is multiplied by the obtained number of particles per gram so as to determine the specific surface area Sb. This can be summarized as the following formula:

[Specific surface area Sb ($cm^2/g$) calculated from sieving]=[True specific gravity $\rho$ ($g/cm^3$)]/[Volume per particle $(4/3)\pi r^3$]×[Surface area Sc per particle ($cm^2/g$)]

The shape factor of the pearl polymerization resin is determined by dividing the aforementioned specific surface area Sa measured by the aeration technique by the specific surface area Sb calculated from sieving. The surface condition of the resin, which varies depending upon the resin polymerizing method used, will produce differences in the coefficients of friction. In the case of the styrene/acrylic (St/Ac) pearl polymerization resin, it has a smooth surface and a grape-like shape. Therefore, when the shape factor is equal to or below 1.30, the amount of the material fed from the mixer (hopper) to the kneader does not vary and thereby it is possible to stably produce toner of good performance.

In the case of the binder resin produced by solution polymerization shown in Table 2, as to the particle size a (mm) of the resin, the upper limit should be equal to 3.000 or below, and the lower limit should be equal to or above the value determined by $(k/c)\times c^3$. The shape factor should be equal to or below 2.20.

The surface condition of the resin, which varies depending upon the resin polymerizing method used, will produce differences in the coefficients of friction. In the case of the styrene/acrylic (St/Ac) solution polymerization resin, it has many irregularities on its surface and has irregular shapes. Since the increase of the specific surface area based on BET theory is out of proportion of the variation in coefficient of friction, when the shape factor is equal to or below 2.20, the amount of the material fed from the mixer (hopper) to the kneader does not vary and thereby it is possible to stably produce toner of good performance.

(a) Method for evaluating background fogginess (BG)

Each toner of the thus produced test specimens Nos.1 to 16 and 1' shown in Table 3 was set in the toner hopper of a copier (SD-2060, a product of Sharp Kabushiki Kaisha). For each toner, the initial copy and the copy after 100K sheets were checked for background fogginess (BG) to evaluate the toner.

The evaluation was performed as follows:

TABLE 2

| | Toner name | Resin particle size (a)mm | kx(1/b) × $c^2$ (k = 1.8 × $10^{-2}$) | Shape coefficient | Powder amount (c)% | Powder particle size (b)μm | Feeding amount of supplying material kg/h | Ejecting amount of the kneaded kg/h | Crushing yield % | Direct product yield % | Image quality evaluation |
|---|---|---|---|---|---|---|---|---|---|---|---|
| CEx. 8 | Toner 12 | 0.350 | — | 2.20 | — | — | 100 | 100 | 85 | 78 | Good |
| CEx. 9 | Toner 13 | 0.350 | 0.4 | 2.20 | 10 | 4.5 | 100 | 82 | 83 | 82 | Bad |
| Ex. 5 | Toner 14 | 0.400 | 0.4 | 2.20 | 10 | 4.5 | 100 | 100 | 85 | 88 | Good |
| CEx. 10 | Toner 15 | 0.240 | 0.256 | 2.20 | 8 | 4.5 | 100 | 85 | 80 | 82 | Bad |
| Ex. 6 | Toner 16 | 0.256 | 0.256 | 2.20 | 8 | 4.5 | 100 | 100 | 85 | 86 | Good |
| Ex. 7 | Toner 17 | 3.000 | 0.4 | 2.20 | 10 | 4.5 | 100 | 100 | 85 | 88 | Good |
| CEx. 11 | Toner 18 | 3.100 | 0.4 | 2.20 | 10 | 4.5 | 100 | 100 | 81 | 83 | Bad |
| CEx. 12 | Toner 19 | 0.400 | 0.4 | 2.30 | 10 | 4.5 | 86 | 86 | 81 | 83 | Bad |
| CEx. 13 | Toner 20 | 0.400 | — | 2.10 | — | — | 100 | 100 | 85 | 78 | Good |
| CEx. 14 | Toner 21 | 0.400 | 0.45 | 2.10 | 10 | 4.0 | 100 | 90 | 80 | 81 | Bad |
| Ex. 8 | Toner 22 | 0.450 | 0.45 | 2.10 | 10 | 4.0 | 100 | 100 | 85 | 88 | Good |

CEx.: represents Comparative Example
Ex: represents Example

EXAMPLE 9

1) Method for producing extra-fine powder-mixed toner

Styrene acrylic copolymer is used as the binder resin for the starting material; carbon black is as a coloring agent; polypropylene resin is used as an anti-offset agent; and quaternary ammonium salt is used as a charge control agent. A hundred parts by weight of the binder resin, 6 parts of the coloring agent by weight, 2.5 parts of the charge control agent, 1.5 parts of the anti-offset agent are prepared. After these materials are mixed, the compound is fused and kneaded by a bi-axial extruder kneading machine. The resultant is cooled, then crushed by a jet mill crusher and classified so as to remove toner having a particle size equal to or below 5.0 μm. Thus, toner having a desired particle size without extra-fine particles is prepared.

The extra-fine toner which arises in the above normal toner production process having a particle size equal to or below the prescribed diameter, is loaded and mixed together with the starting material. Then, toner containing the extra-fine toner is produced by the same production method as in the above normal process.

2) Method for producing extra-fine powder-mixed toner for evaluation

As shown in Table 3, for test specimens Nos.1 to 16, the extra-fine powder-mixed toner was mixed at a blending ratio of 5, 10, 15, 20 or 25 wt. %, respectively. The charge control agent was mixed at a different blending ratio, selected from an amount equivalent to, 1.5 times, 2 times and 2.5 times that of the normal process, in order to take the presence of the charge control agent already mingled in the extra-fine toner into consideration. Thus, the extra-fine powder-mixed toner for evaluation was prepared. Here, the toner was mixed using a super mixer and the mean particle size of the toner was set at 10.0 μm.

The toner specimen No.1' was the one produced as a comparative example, which was produced from the normal process containing no extra-fine toner.

3) Method for evaluation

An original document standardized in Sharp Kabushiki Kaisha, containing black solid circles of 5.5 mm in diameter and hollowed circles of 4.0 mm in diameter was used to produce three copies of A4 sized copy paper under the correct exposure in the normal mode designated by exposure adjustment. Using a whiteness meter (trade name: HUNTER WHITENESS METER (produced by NIPPON DENSHOKU KOGYOU), the whiteness was metered in the white area in the original document and each of the copies so that the difference obtained by subtracting the whiteness of the original from the whiteness of the copy was taken as the background fogginess (BG).

TABLE 3

Blending ratios of the extra-fine powder and charge control agent (CCA) in the recycling processes

| Test specimen No. | Extra-fine powder-blending ratio (wt, %) | CCA blending ratio in the recycling process relative to that in normal process (times) |
|---|---|---|
| 1 | 5 | 1 |
| 2 | 5 | 1.5 |
| 3 | 5 | 2 |
| 4 | 5 | 2.5 |
| 5 | 10 | 1 |
| 6 | 10 | 1.5 |
| 7 | 10 | 2 |
| 8 | 10 | 2.5 |
| 9 | 20 | 1 |
| 10 | 20 | 1.5 |
| 11 | 20 | 2 |
| 12 | 20 | 2.5 |
| 13 | 25 | 1 |
| 14 | 25 | 1.5 |
| 15 | 25 | 2 |
| 16 | 25 | 2.5 |
| 1' | 0 | 1 |

The three values of background fogginess (BG) for three copies were averaged for the value of background fogginess (BG). In this test, when the value of background fogginess for the initial check fell out of the prescribed range (≦1.0), the evaluation for the copy after 100K was not made.

(b) Method for evaluating toner scatter

Each toner of the test specimens Nos.1 to 12 and 1' shown in Table 3 was set in the toner hopper of a copier (SD-2060, a product of Sharp Kabushiki Kaisha). For each toner, 100K sheets of copies were produced using an original document with a print ratio of 7%, standardized by Sharp Kabushiki Kaisha. Thereafter, the developing vessel inside the copier was taken out. The developer adhering to the detached developing vessel was dusted off, and the amount was weighed.

(c) Method for evaluating the image density (ID)

Each toner of the test specimens Nos.1 to 16 and 1' shown in Table 3 was set in the toner hopper of a copier (SD-2060, a product of Sharp Kabushiki Kaisha). For each toner, the initial copy and the copy after 100K sheets were checked for image density (ID) to evaluate the toner.

An original document standardized in Sharp Kabushiki Kaisha, containing black solid circles of 5.5 mm in diameter and hollowed circles of 4.0 mm in diameter was used to produce three copies of A4 sized copy paper under the correct exposure in the normal mode designated by exposure adjustment. Five black solid areas on the reproduced copy sheet were metered using an image density meter, produced by Macbeth Co., Ltd. These measurements were averaged to produce a value of image density. In this test, when the value of image density for the initial check fell out of the prescribed range (≧1.3), the evaluation for the copy after 100K was not made.

4) Evaluation result

The background fogginess (BG), the scattered amount of toner and the image density (ID) obtained are shown in Table 4.

TABLE 4

| Test | BG (≦1.0) | | Scattered amount of | ID (≧1.3) | |
|---|---|---|---|---|---|
| specimen No. | Initial copy | After 100 k | toner (≦150 mg) | Initial copy | After 100 k |
| 1 | 0.55 | 0.57 | 101 | 1.36 | 1.33 |
| 2 | 0.51 | 0.50 | 93 | 1.25 | |
| 3 | 0.42 | 0.44 | 91 | 1.13 | |
| 4 | 0.41 | 0.44 | 85 | 1.09 | |
| 5 | 0.69 | 0.75 | 138 | 1.40 | 1.40 |
| 6 | 0.63 | 0.66 | 122 | 1.35 | 1.36 |
| 7 | 0.55 | 0.58 | 103 | 1.31 | 1.32 |
| 8 | 0.45 | 0.46 | 89 | 1.18 | |
| 9 | 0.98 | 1.01 | 175 | 1.43 | 1.45 |
| 10 | 0.79 | 0.81 | 144 | 1.42 | 1.42 |
| 11 | 0.61 | 0.67 | 121 | 1.35 | 1.32 |
| 12 | 0.55 | 0.56 | 103 | 1.21 | |
| 13 | 1.72 | | | 1.45 | 1.41 |
| 14 | 1.58 | | | 1.44 | 1.42 |
| 15 | 1.42 | | | 1.38 | 1.35 |
| 16 | 1.11 | | | 1.27 | |
| 1' | 0.44 | 0.46 | 85 | 1.44 | 1.42 |

As shown in Tables 3 and 4, for the test specimens Nos.1, 5, 9 and 13, the blending ratio of the charge control agent in the recycling process was set equal to the blending ratio of the charge control agent in the normal process while the blending ratio of the extra-fine toner in the recycling process was changed, or set at 5, 10, 20 and 25 wt. %. That is, these tests were to search the upper limit of the blending ratio of the extra-fine toner when the charge control agent was blended at the same ratio as in the normal process.

In this case, when the blending ratio of the extra-fine toner exceeded 10 wt. %, the background fogginess was excessive and toner scatter exceeding the prescribed range was observed. In contrast, when the blending ratio was equal to 10 wt. % or below, the background fogginess (BG), the scattered amount of toner and the image density (ID) all fell within the prescribed ranges.

For the test specimens Nos.1, 2, 5, 6, 9, 10, 13 and 14, the blending ratio of the extra-fine toner in the recycling process was set at 5 wt. %, 10 wt. %, 20 wt. %, or 25 wt. %, respectively, and the blending ratio of the charge control agent in the recycling process was changed, or set equal to, or at 1.5 times the blending ratio of the charge control agent in the normal process. That is, these tests were to search the lower limit of the blending ratio of the charge control agent in the recycling process.

In this case, when the blending ratio of the charge control agent in the recycling process was the same as in the normal process, the result was already shown in the above. When the ratio was set at 1.5 times that in the normal process, the blending ratio of the extra-fine toner in the recycling process was 25 wt. %, the background fogginess at the initial stage fell out of the prescribed range (≦1.0). In the case of 5 wt. %, the background fogginess and the toner scatter fell within the prescribed ranges, but the image density fell out of the prescribed range (≧1.3).

For the test specimens Nos.3, 4, 7, 8, 11, 12, 15 and 16, the blending ratio of the over-pulverized toner in the recycling process was set at 5 wt. %, 10 wt. %, 20 wt. %, or 25 wt. %, respectively, and the blending ratio of the charge control agent in the recycling process was set at 2 times or 2.5 times the blending ratio of the charge control agent in the normal process. These tests were to determine the upper limit of the blending ratio of the charge control agent in the recycling process.

When the blending ratio of the charge control agent mixed in the recycling process was set at 2.5 times, the image density at the initial stage was not enough, or fell out of the prescribed range (≧1.3). When the blending ratio of the charge control agent was set at 2.0, with the blending ratio of the extra-fine toner in the recycling process set at 25 wt. %, the background fogginess at the initial stage fell out of the prescribed range (≦1.0). When it was set at 5 wt. %, the background fogginess and the toner scatter fell within the prescribed ranges but the image density (ID) fell out of the prescribed range (≧1.3).

From the above result, when the blending ratio of the extra-fine toner in the recycling process is set between 5 wt. % and 10 wt. % and the blending ratio of the charge control agent in the recycling process is set at the same blending ratio as in the normal process, the background fogginess, the toner scatter and the image density all fall within respective prescribed ranges, making it possible to produce a stabilized quality of image.

When the ratio of the extra-fine toner is set more than 10 wt. %, specifically, between 10 wt. % and 20 wt. %, if the blending ratio of the coloring agent is set at the same as in the normal process, the charge control agent should be mixed at a ratio of 1.5 to 2.0 times the blending ratio in the normal process, so that the toner scatter and the image density fall within respective prescribed ranges, making it possible to produce a stabilized quality of image.

In this way, when the amount of the extra-fine toner is within a limited range, it is important to set the blending ratio of the charge control agent within a range of 1.5 to 2 times the blending ratio in the normal process.

EXAMPLE 10

1) Method for producing extra-fine powder-mixed toner

Toner is prepared by the same method as in Example 9.

2) Method for producing extra-fine powder-mixed toner for evaluation

As shown in Table 5, test specimens Nos.17 to 32 were prepared in the same manner as in the Example 9. That is, the blending ratio of the extra-fine toner in the recycling process was of 5, 10, 15 or 20 wt. %, respectively. Since a larger amount of the coloring agent mingles in the extra-fine toner than in the normal toner having a prescribed particle size, the coloring agent in the recycling process was mixed at a different blending ratio, selected from an amount equivalent to, 0.83 times, 0.66 times and 0.5 times that of the normal process, in order to take the presence of the coloring agent already mingled in the extra-fine toner into consideration. Thus, the powder-mixed toner for evaluation was prepared. Here, toner conditions here were the same as for the test specimens Nos.1 to 16 in Example 9.

The test specimen No.1" was the one produced as a comparative example, which was produced from the normal process containing no extra-fine toner.

3) Method for evaluation

The evaluation methods for the background fogginess (BG), the toner scattering and the image density (ID) are the same as in Example 9, the detailed description will be omitted.

4) Evaluation result

The background fogginess (BG), the toner scatter and the image density (ID) obtained are shown in Table 6.

As shown in Tables 5 and 6, for the test specimens Nos.20, 24, 28 and 32, the blending ratio of the coloring agent in the recycling process was set at the same with the blending ratio of the coloring agent in the normal process taking into account the presence of the coloring agent mingled in the extra-fine toner while the blending ratio of the extra-fine toner in the recycling process was set at 5, 10, 20 and 25 wt. %. That is, these tests were to search the upper limit of the blending ratio of the extra-fine toner when the coloring agent was blended at the same ratio as in the normal process.

In this case, when the blending ratio of the extra-fine toner exceeded 10 wt. %, some cases were observed in which the background fogginess and the scattered amount of toner exceeded the prescribed range. When the blending ratio of the extra-fine toner was equal to 10 wt. % or below, the background fogginess, the toner scatter and the image density (ID) all fell within the prescribed ranges.

TABLE 5

| Blending ratios of the extra-fine powder and carbon in the recycling processes | | |
|---|---|---|
| Test specimen No. | Extra-fine powder-blending ratio (wt, %) | Coloring agent blending ratio in the recycling process relative to that in normal process (times) |
| 17 | 5 | 0.5 |
| 18 | 5 | 0.66 |
| 19 | 5 | 0.83 |
| 20 | 5 | 1 |
| 21 | 10 | 0.5 |
| 22 | 10 | 0.66 |
| 23 | 10 | 0.83 |
| 24 | 10 | 1 |
| 25 | 20 | 0.5 |
| 26 | 20 | 0.66 |
| 27 | 20 | 0.83 |
| 28 | 20 | 1 |
| 29 | 25 | 0.5 |

TABLE 5-continued

| Blending ratios of the extra-fine powder and carbon in the recycling processes | | |
|---|---|---|
| Test specimen No. | Extra-fine powder-blending ratio (wt, %) | Coloring agent blending ratio in the recycling process relative to that in normal process (times) |
| 30 | 25 | 0.66 |
| 31 | 25 | 0.83 |
| 32 | 25 | 1 |
| 1" | 0 | 1 |

TABLE 6

| Test | BG (≦1.0) | | Scattered amount of | ID (≧1.3) | |
|---|---|---|---|---|---|
| specimen No. | Initial copy | After 100 k | toner (≦150 mg) | Initial copy | After 100 k |
| 17 | 0.43 | 0.44 | 99 | 1.09 | |
| 18 | 0.59 | 0.62 | 108 | 1.15 | |
| 19 | 0.71 | 0.73 | 121 | 1.21 | |
| 20 | 0.77 | 0.74 | 127 | 1.32 | 1.33 |
| 21 | 0.52 | 0.52 | 101 | 1.22 | |
| 22 | 0.73 | 0.77 | 115 | 1.33 | 1.33 |
| 23 | 0.82 | 0.85 | 131 | 1.37 | 1.39 |
| 24 | 0.89 | 0.92 | 143 | 1.44 | 1.43 |
| 25 | 0.64 | 0.66 | 103 | 1.24 | |
| 26 | 0.77 | 0.80 | 131 | 1.35 | 1.37 |
| 27 | 0.92 | 0.93 | 139 | 1.42 | 1.41 |
| 28 | 1.15 | | | 1.43 | 1.43 |
| 29 | 0.89 | 0.93 | 157 | 1.26 | |
| 30 | 1.05 | | | 1.39 | 1.41 |
| 31 | 1.37 | | | 1.45 | 1.45 |
| 32 | 1.51 | | | 1.44 | 1.45 |
| 1" | 0.44 | 0.46 | 85 | 1.44 | 1.42 |

For the test specimens Nos.19, 20, 23, 24, 27, 28, 31 and 32, the blending ratio of the extra-fine toner in the recycling process was set at 5 wt. %, 10 wt. %, 20 wt. %, or 25 wt. %, respectively, and the blending ratio of the coloring agent in the recycling process was set equal to, or at 0.83 times the blending ratio of the coloring agent in the normal process. That is, these tests were to search the lower limit of the blending ratio of the coloring agent in the recycling process.

In this case, when the blending ratio of the coloring agent was increased, the background fogginess and the toner scatter were improved but the image density became poor. When the blending ratio of the extra-fine toner was equal to or below 5 wt. %, the image density was poor. When it was equal to or above 25 wt. %, the image density was satisfactory but background fogginess and toner scattering occurred.

From the above, when the extra-fine toner is mingled in an amount between 10 wt. % and 20 wt. %, if the blending ratio of the coloring agent is set at 0.83 times, the background fogginess, the toner scattering and the image density all fall within respective prescribed ranges.

For the test specimens Nos.17, 18, 21, 22, 25, 26, 29 and 30, the blending ratio of the extra-fine toner in the recycling process was set at 5 wt. %, 10 wt. %, 20 wt. %, or 25 wt. %, respectively, and the blending ratio of the coloring agent in the recycling process was set at 0.5 times or 0.66 times the blending ratio of the coloring agent in the normal process. These tests were to determine the upper limit of the blending ratio of the coloring agent in the recycling process.

Similarly as above, when the blending ratio of the extra-fine toner was equal to or below 5 wt. %, the image density was poor. When it was equal to or above 25 wt. %, background fogginess and toner scattering occurred. From this, when the blending ratio of the extra-fine toner is set between 10 wt. % and 20 wt. % and the blending ratio of the coloring agent in the recycling is set at 0.66 times the blending ratio as in the normal process, the background fogginess, the toner scatter and the image density all fall within respective prescribed ranges.

To sum up, when the blending ratio of the extra-fine toner in the recycling process is set equal to or below 10 wt. % and the blending ratio of the coloring agent in the recycling process is set at the same blending ratio as in the normal process, the background fogginess, the toner scatter and the image density all fall within respective prescribed ranges, making it possible to produce a stabilized quality of image. When the ratio of the extra-fine toner is set between 10 wt. % and 20 wt. %, if the blending ratio of the charge control agent is set at the same as in the normal process, the coloring agent should be mixed at a ratio of 0.66 to 0.83 times the blending ratio in the normal process, so that the toner scatter and the image density fall within respective prescribed ranges, making it possible to produce a stabilized quality of image.

In this way, when the amount of the extra-fine toner is within a limited range, it is effective to set the blending ratio of the coloring agent within a range of 0.66 to 0.83 times the blending ratio in the normal process.

EXAMPLE 11

1) Method for producing extra-fine powder-mixed toner

Toner is prepared by the same method as in Example 9.

2) Method for producing extra-fine powder-mixed toner for evaluation

As shown in Table 7, test specimens Nos.33 to 48 were prepared in the same manner as in the Example 9. That is, the blending ratio of the extra-fine toner in the recycling process was of 5, 10, 15 or 20 wt. %, respectively. Further, the blending ratio of the charge control agent (CCA) in the recycling process is set at 1.5 times, 1.6 times, 1.8 times or 2.0 times the blending ratio in the normal process, and the blending ratio of the coloring agent in the recycling process is set equal to, or at 0.8 times, 0.6 times, 0.5 times the blending ratio in the normal process. Thus, the extra-fine powder-mixed toner for evaluation was prepared. Here, toner conditions here were the same as for the test specimens Nos.1 to 16 in Example 9.

3) Method for evaluation

The evaluation methods for the background fogginess (BG), the toner scattering and the image density (ID) are the same as in Examples 9 and 10, the detailed description will be omitted.

4) Evaluation result

The background fogginess (BG), the toner scatter and the image density (ID) obtained are shown in Table 8.

For the test specimens Nos.33 to 36, the blending ratio of the extra-fine toner in the recycling process was set at 5 wt. %, the blending ratio of the charge control agent was set at 1.5, or 2 times and the blending ratio of the coloring agent is set at 0.6 or 0.8 times. When the blending ratio of the extra-fine toner was 5 wt. %, the image density fell out of the prescribed range (1.38).

For the test specimens Nos.45 to 48, the blending ratio of the extra-fine toner in the recycling process was set at 20 wt. %, the blending ratio of the charge control agent was set at 1.5, or 2 times and the blending ratio of the coloring agent is set at 0.6 or 0.8 times. When the blending ratio of the extra-fine toner was greater than 20 wt. %, the background fogginess (BG) exceeding 0.7 and the scattered toner amount exceeding 100 mg fell out of respective prescribed ranges.

For the test specimens Nos.37 to 44, the blending ratio of the extra-fine toner in the recycling process was set at 10 wt. % or 20 wt. %, the blending ratio of the charge control agent was set at 1.6, or 1.8 times and the blending ratio of the coloring agent is set at 0.7 or 0.75 times.

In these conditions, all the criteria were satisfied, the image density, 1.38 or more, the background fogginess (BG), 0.7 or below, and the scattered toner amount, 100 mg or below, making it possible to produce improved quality of image.

From the above result, the following conditions are effective to obtain improved images: that is, when the blending ratio of the extra-fine toner in the recycling process is set between 10 wt. % and 15 wt. %, if the blending ratio of the charge control agent in the recycling process is set at 1.6 to 1.8 times the blending ratio in the normal process and the blending ratio of the coloring agent is set at 0.7 to 0.75 times that in the normal process, the background fogginess, the toner scatter and the image density all fall within respective prescribed ranges.

The present invention offers the following effects.

First, in accordance with the toner producing methods written in the first to seventh features of the invention, since the extra-fine toner arising in the producing course is recycled in the producing process, it is possible to improve the productivity of the toner. Particularly, the ejected amount of the kneaded compound from the kneader can be made uniform as in the case where no recycling is made, thus making it possible to produce a stabilized good toner.

TABLE 7

Blending ratios of the extra-fine powder, carbon and charge control agent (CCA) in the recycling processes

| Test specimen No. | Extra-fine powder blending ratio (wt, %) | Coloring agent blending ratio in the recycling process relative to that in normal process (times) | CCA blending ratio in the recycling process relative to that in normal process (times) |
|---|---|---|---|
| 33 | 5 | 0.6 | 1.5 |
| 34 | 5 | 0.6 | 2.0 |
| 35 | 5 | 0.8 | 1.5 |
| 36 | 5 | 0.8 | 2.0 |
| 37 | 10 | 0.7 | 1.6 |
| 38 | 10 | 0.7 | 1.8 |
| 39 | 10 | 0.75 | 1.6 |
| 40 | 10 | 0.75 | 1.8 |
| 41 | 15 | 0.7 | 1.6 |
| 42 | 15 | 0.7 | 1.8 |
| 43 | 15 | 0.75 | 1.6 |
| 44 | 15 | 0.75 | 1.8 |
| 45 | 20 | 0.6 | 1.5 |
| 46 | 20 | 0.6 | 2.0 |
| 47 | 20 | 0.8 | 1.5 |
| 48 | 20 | 0.8 | 2.0 |

TABLE 8

| Test | BG (≦0.7) | | Scattered amount of | ID (≧1.38) | |
|---|---|---|---|---|---|
| specimen No. | Initial copy | After 100 k | toner (≦100 mg) | Initial copy | After 100 k |
| 33 | 0.39 | 0.40 | 52 | 1.27 | |
| 34 | 0.49 | 0.48 | 69 | 1.19 | |
| 35 | 0.41 | 0.41 | 60 | 1.35 | |
| 36 | 0.50 | 0.49 | 71 | 1.32 | |

TABLE 8-continued

| Test specimen No. | BG (≦0.7) Initial copy | BG (≦0.7) After 100 k | Scattered amount of toner (≦100 mg) | ID (≧1.38) Initial copy | ID (≧1.38) After 100 k |
|---|---|---|---|---|---|
| 37 | 0.39 | 0.38 | 72 | 1.39 | 1.41 |
| 38 | 0.45 | 0.47 | 83 | 1.43 | 1.42 |
| 39 | 0.42 | 0.41 | 75 | 1.40 | 1.39 |
| 40 | 0.50 | 0.52 | 81 | 1.44 | 1.43 |
| 41 | 0.52 | 0.55 | 85 | 1.44 | 1.45 |
| 42 | 0.63 | 0.62 | 90 | 1.45 | 1.46 |
| 43 | 0.57 | 0.54 | 82 | 1.42 | 1.41 |
| 44 | 0.65 | 0.66 | 93 | 1.45 | 1.45 |
| 45 | 0.89 | 0.93 | 157 | 1.46 | 1.44 |
| 46 | 1.05 | | | 1.46 | 1.46 |
| 47 | 1.37 | | | 1.45 | 1.45 |
| 48 | 1.51 | | | 1.46 | 1.45 |

Even when the binder resin for the production of toner is the one produced by pearl polymerization or solution polymerization, it is possible to produce toner which is good at image forming by using toner particles having a particle size classified in an appropriate range.

It is also possible to feed a constant amount of the compound from the kneader after the mixture of the binder resin and the extra-fine toner particles. In particular, the surface condition of the produced binder resin depends on the production method, either it is produced by pearl polymerization or solution polymerization. Even with such difference in surface condition, a constant amount of the compound can be fed into the kneader, thus making it possible to stably produce good toner.

In accordance with the toner producing methods written in the eighth to eleventh features of the invention, it is possible to efficiently recycle extra-fine toner. Besides, the recycling process using the extra-fine toner can be effected in the same manner as the normal process without modifying any steps except the adjustment of the blending ratio of the extra-fine powder toner. Therefore, no complicated step is needed, resultantly it is possible to reduce the cost.

Further, since toner fogginess as well as toner scattering can be inhibited with a satisfactory image density, it is possible to produce toner which can offer stable properties and a stable quality of image.

In particular, in accordance with the methods written in the ninth to eleventh features of the invention, a larger amount of the extra-fine toner can be added than in the case of the eighth configuration. Thus, it is possible to further attain efficient recycling of the extra-fine toner.

In accordance with the method written in the eleventh feature, it is possible to efficiently prevent toner fogginess and toner scattering in a more improved manner, resultantly, the toner produced in this method makes it possible to produce as good a quality of image as the toner containing no extra-fine toner.

What is claimed is:

1. A toner producing method for producing toner particles having a prescribed particle size, said method comprising the steps of:

mixing a coloring agent and a binder resin as main components to provide a mixture;

heating and kneading the mixture to provide a kneaded compound;

cooling the kneaded compound;

crushing the cooled compound into toner particles;

classifying the particles to remove extra-fine toner particles; and returning the extra-fine toner particles smaller than the prescribed size to the mixing step for recycling;

wherein the binder resin has a particle size, which is set so that the tractive ability of the compound entering the kneading shaft during kneading is equivalent to that of the case where no extra-fine toner is added, and this binder resin is blended with the extra-fine toner so as to eject a constant amount of the kneaded compound.

2. A toner producing method according to claim 1, wherein the binder resin is produced by pearl polymerization.

3. A toner producing method according to claim 1, wherein the binder resin is produced by solution polymerization.

4. A toner producing method according to claim 2, wherein the binder resin is composed of particles having a particle diameter a (mm) which satisfies the following condition:

$$3.0 \geqq a \geqq k \times (1/b) \times c^2$$

where b is the mean particle diameter ($\mu$m) of the extra-fine toner, c is the blending ratio (wt. %) of the extra-fine toner, and k is equal to $1.5 \times 10^{-2}$ when the binding resin is produced by pearl polymerization.

5. A toner producing method according to claim 3, wherein the binder resin is composed of particles having a particle diameter a (mm) which satisfies the following condition:

$$3.0 \geqq a \geqq k \times (1/b) \times c^2$$

where b is the mean particle diameter ($\mu$m) of the extra-fine toner, c is the blending ratio (wt. %) of the extra-fine toner, and k is equal to $1.8 \times 10^{-2}$ when the binding resin is produced by solution polymerization.

6. A toner producing method according to claim 4, wherein when the binder resin is of styrene/acrylic (St/Ac) resin based on pearl polymerization, the shape factor of the particle of the binder resin is equal to or below 1.30, where the shape factor is defined as the ratio of the specific surface area Sa obtained by the measurement based on the aeration method and the specific surface area Sb calculated from sieving.

7. A toner producing method according to claim 5, wherein when the binder resin is of styrene/acrylic (St/Ac) resin based on solution polymerization, the shape factor of the particle of the binder resin is equal to or below 2.20, where the shape factor is defined as the ratio of the specific surface area Sa obtained by the measurement based on the aeration method and the specific surface area Sb calculated from sieving.

8. A toner producing method in which the normal process is carried out by the steps of: mixing starting materials comprising a binder resin, a coloring agent, and a charge control agent; fusing and kneading the mixture to provide a kneaded compound; cooling the kneaded compound; crushing the cooled compound into particles; and classifying the particles into toner particles having a desired particle size diameter and extra-fine powder toner equal to or below a prescribed size, said method comprising the steps of:

recycling the extra-fine powder toner by mixing it with the starting materials to provide a mixture;

fusing and kneading the mixture to provide a kneaded compound;

cooling the kneaded compound;

crushing the compound into toner particles; and classifying the particles to remove extra-fine toner particles, being characterized in that when the extra-fine powder toner is blended with the starting materials, the blending ratio of the extra-fine powder toner to the starting material is set between 5 wt. % and 10 wt. %, and the blending ratios of the charge control agent and the coloring agent are set equal to those of the normal process.

9. A toner producing method in which the normal process is carried out by the steps of: mixing starting materials comprising a binder resin, a coloring agent, and a charge control agent; fusing and kneading the mixture to provide a kneaded compound; cooling the kneaded compound; crushing the cooled compound into particles; and classifying the particles into toner particles having a desired particle size diameter and extra-fine powder toner equal to or below a prescribed size, said method comprising the steps of:

recycling the extra-fine powder toner by mixing it with the starting materials to provide a mixture;

fusing and kneading the mixture to provide a kneaded compound;

cooling the kneaded compound;

crushing the compound into toner particles; and classifying the particles to remove extra-fine toner particles, being characterized in that when the extra-fine powder toner is blended with the starting materials, the blending ratio of the extra-fine powder toner to the starting material is set between 10 wt. % and 20 wt. %, and the blending ratio of the coloring agent is set equal to that of the coloring agent in the normal process while the blending ratio of the charge control agent is set between 1.5 and 2 times that of the normal process.

10. A toner producing method in which the normal process is carried out by the steps of: mixing starting materials comprising a binder resin, a coloring agent, and a charge control agent; fusing and kneading the mixture to provide a kneaded compound; cooling the kneaded compound; crushing the cooled compound into particles; and classifying the particles into toner particles having a desired particle size diameter and extra-fine powder toner equal to or below a prescribed size, said method comprising the steps of:

recycling the extra-fine powder toner by mixing it with the starting materials to provide a mixture;

fusing and kneading the mixture to provide a kneaded compound;

cooling the kneaded compound;

crushing the compound into toner particles; and classifying the particles to remove extra-fine toner particles, being characterized in that when the extra-fine powder toner is blended with the starting materials, the blending ratio of the extra-fine powder toner to the starting material is set between 10 wt. % and 20 wt. %, and the blending ratio of the charge control agent is set equal to that of the charge control agent in the normal process while the blending ratio of the coloring agent is set between 0.66 and 0.83 times that of the normal process.

11. A toner producing method in which the normal process is carried out by the steps of: mixing starting materials comprising a binder resin, a coloring agent, and a charge control agent; fusing and kneading the mixture to provide a kneaded compound; cooling the kneaded compound; crushing the cooled compound into particles; and classifying the particles into toner particles having a desired particle size diameter and extra-fine powder toner equal to or below a prescribed size, said method comprising the steps of:

recycling the extra-fine powder toner by mixing it with the starting materials to provide a mixture;

fusing and kneading the mixture to provide a kneaded compound;

cooling the kneaded compound;

crushing the compound into toner particles; and classifying the particles to remove extra-fine toner particles, being characterized in that when the extra-fine powder toner is blended with the starting materials, the blending ratio of the extra-fine powder toner to the starting material is set between 10 wt. % and 15 wt. %, and the blending ratio of the charge control agent is set between 1.6 and 1.8 times that in the normal process while the blending ratio of the coloring agent is set between 0.7 and 0.75 times that of the normal process.

12. A toner producing method for producing toner particles having a prescribed particle size, said method comprising the steps of:

mixing a coloring agent and a binder resin as main components to provide a mixture;

heating and kneading the mixture to provide a kneaded compound;

cooling the kneaded compound;

crushing the cooled compound into toner particles;

classifying the particles to remove extra-fine toner particles; and returning the extra-fine toner particles smaller than the prescribed size to the mixing step for recycling;

wherein the binder resin has a particle size, which is set so that the tractive ability of the compound entering the kneading shaft during kneading is equivalent to that of the case where no extra-fine toner is added, and this binder resin is blended with the extra-fine toner so as to eject a constant amount of the kneaded compound, wherein the binder resin is composed of particles having a particle size diameter a (mm) which satisfies the following condition:

$$3.0 \leqq a \leqq k \times (1/b) \times c^2$$

where b is the mean particle diameter ($\mu$m) of the extra-fine toner, c is the blending ratio (wt. %) of the extra-fine toner, and k is equal to $1.8 \times 10^{-2}$.

* * * * *